US008701259B2

(12) United States Patent
Kramer et al.

(10) Patent No.: US 8,701,259 B2
(45) Date of Patent: Apr. 22, 2014

(54) MAIN SHAFT REMANUFACTURING

(75) Inventors: Martin S. Kramer, Clarkston, MI (US); Roger L. Briggs, Lake Orion, MI (US); Steven J. Ross, Marquette, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 335 days.

(21) Appl. No.: 12/955,975

(22) Filed: Nov. 30, 2010

(65) Prior Publication Data

US 2012/0131799 A1 May 31, 2012

(51) Int. Cl.
*B23P 6/00* (2006.01)

(52) U.S. Cl.
USPC ..... 29/402.18

(58) Field of Classification Search
USPC ..... 29/402.03, 402.04, 405.05, 402.07, 29/402.09, 402.11, 402.18, 402.19, 29/407.01, 407.05
See application file for complete search history.

(56) References Cited

U.S. PATENT DOCUMENTS

| | | | | |
|---|---|---|---|---|
| 3,419,949 | A * | 1/1969 | Huebner | 29/888.08 |
| 5,085,014 | A * | 2/1992 | Sandhof | 451/51 |
| 5,148,636 | A * | 9/1992 | Judge et al. | 451/28 |
| 5,268,045 | A * | 12/1993 | Clare | 148/518 |
| 5,915,743 | A * | 6/1999 | Palma | 29/402.18 |
| 6,018,869 | A * | 2/2000 | Slankard et al. | 29/894.361 |
| 6,302,625 | B1 * | 10/2001 | Carey et al. | 409/132 |
| 6,365,274 | B1 * | 4/2002 | Scheckenbach et al. | 428/402 |
| 7,435,199 | B2 * | 10/2008 | Showalter | 475/213 |
| 2004/0048558 | A1 * | 3/2004 | Suzuki et al. | 451/61 |
| 2005/0044653 | A1 * | 3/2005 | Wakao et al. | 15/302 |
| 2005/0274190 | A1 * | 12/2005 | Neumann | 73/718 |
| 2006/0021831 | A1 * | 2/2006 | Yamamoto | 188/72.7 |
| 2006/0042903 | A1 * | 3/2006 | Oki et al. | 192/70.2 |
| 2007/0204453 | A1 * | 9/2007 | Sun et al. | 29/407.07 |
| 2007/0248457 | A1 * | 10/2007 | Dodd et al. | 415/173.4 |
| 2008/0092450 | A1 * | 4/2008 | Balduck et al. | 49/404 |
| 2009/0320263 | A1 * | 12/2009 | Potje et al. | 29/428 |
| 2010/0031815 | A1 * | 2/2010 | Fish | 92/169.1 |

FOREIGN PATENT DOCUMENTS

| | | |
|---|---|---|
| DE | 10 2009 049 323 | * 10/2009 |
| DE | 10 2009 049323 | * 10/2009 |

OTHER PUBLICATIONS

Davis, Copper and Copper Alloys, Jan. 1, 2001, ASM International, p. 150.*

* cited by examiner

*Primary Examiner* — David Bryant
*Assistant Examiner* — Lee Holly

(57) ABSTRACT

A method of re-manufacturing a shaft-hub assembly to be used in a transfer case, the method including the steps of: determining an initial diameter of a journal bearing of a main shaft that has been used in the transfer case; comparing the determined initial diameter to a predetermined minimum threshold, and discarding the main shaft if the determined initial diameter is below the predetermined minimum threshold; if the determined initial diameter is above the predetermined minimum threshold, preparing the bearing surface of the journal bearing for a thermal spray process; thermally spraying an aluminum bronze material onto the bearing surface; and machining the aluminum bronze material to achieve an outside diameter that provides a desired running clearance with a corresponding finished inside diameter of a central bore for a hub to which the main shaft will be assembled in the transfer case.

12 Claims, 3 Drawing Sheets

MAIN SHAFT REMANUFACTURING

BACKGROUND OF INVENTION

The present invention relates generally to main shafts and hubs that may be used in a vehicle transfer case, and more particularly to remanufacturing worn main shafts to allow for re-use instead of disposal.

As transfer cases are employed in four wheel drive vehicles, the main shafts and hubs can become worn to a point when continued use in the worn condition is not desirable. This may occur when improper lubrication issues arise within the transfer case. In such situations, it may be desirable to remanufacture the transfer cases. For transfer cases with worn main shafts and hubs, the parts may have to be replaced with new parts, which adds significantly to the cost of remanufacturing the transfer cases.

SUMMARY OF INVENTION

An embodiment contemplates a method of re-manufacturing a shaft-hub assembly to be used in a transfer case, the method comprising the steps of: determining an initial diameter of a journal bearing of a main shaft that has been used in the transfer case; comparing the determined initial diameter to a predetermined minimum threshold, and discarding the main shaft if the determined initial diameter is below the predetermined minimum threshold; if the determined initial diameter is above the predetermined minimum threshold, preparing the bearing surface of the journal bearing for a thermal spray process; thermally spraying an aluminum bronze material onto the bearing surface; and machining the aluminum bronze material to achieve an outside diameter that provides a desired running clearance with a corresponding finished inside diameter of a central bore for a hub to which the main shaft will be assembled in the transfer case.

An advantage of an embodiment is an ability to reuse the main shaft with improved wear resistance and lubrication properties at the bearing surface on the main shaft. An aluminum bronze coating of the main shaft bearing surface limits scuffing to the hardened steel carburized bearing surface of the hub, even under restricted lubrication conditions of a transfer case. The reuse of the main shaft, and possibly the hub, reduces the cost of remanufacturing a vehicle transfer case.

DETAILED DESCRIPTION

Figure 1:
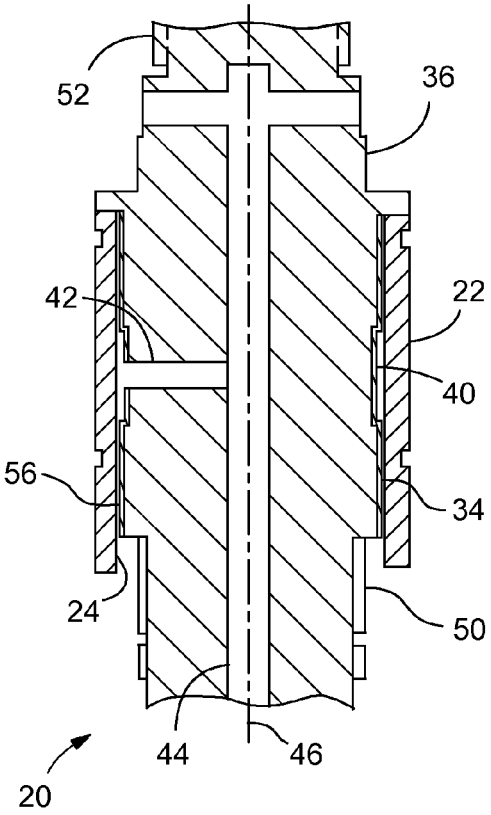
FIG. 1 is a schematic, cross section view of a hub and a portion of a main shaft.

Referring to FIGS. 1-5, a portion of a shaft-hub assembly 20 for a vehicle transfer case is shown. The shaft-hub assembly 20 includes a hub 22 that includes a central bore 24, which has an inside diameter 26 and defines a hub bearing surface 28. The central bore is centered about a central longitudinal axis 46. The hub may include a hub spline 30 that interacts with other components (not shown) of the transfer case. The hub 22 is mounted over and bears against a main shaft bearing surface 32 of a journal bearing 34 of a main shaft 36.

The journal bearing 34 of the main shaft 36 has an outside diameter 38 that is just smaller than the inside diameter 26 of the hub central bore 24 to create a running clearance, discussed below. The bearing surface 32 may have a circumferentially extending depression 40 in fluid communication with a radially extending oil (lube) hole 42. The oil hole 42 may be in fluid communication with a central oil bore 44, which may extend axially along the main shaft 36 centered on the central longitudinal axis 46. The main shaft 36 may also included, for example, a first spline 48, a second spline 50, a third spline 52 and a fourth spline 54, each of which selectively interact with other components (not shown) of the transfer case.

Figure 2:
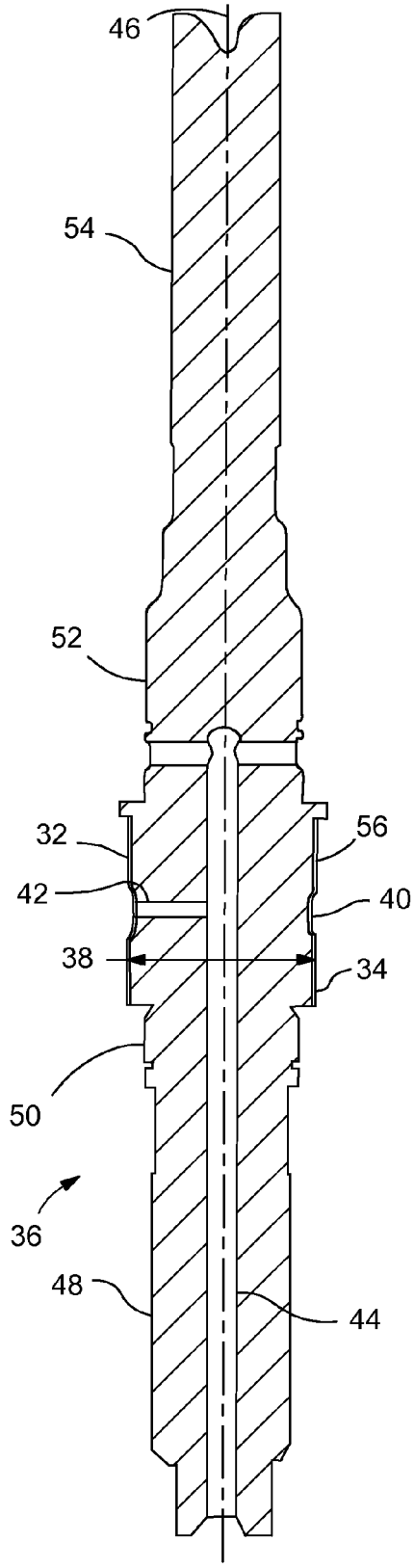
FIG. 2 is a schematic, cross section view, on a reduced scale, of the main shaft.
Figure 3:
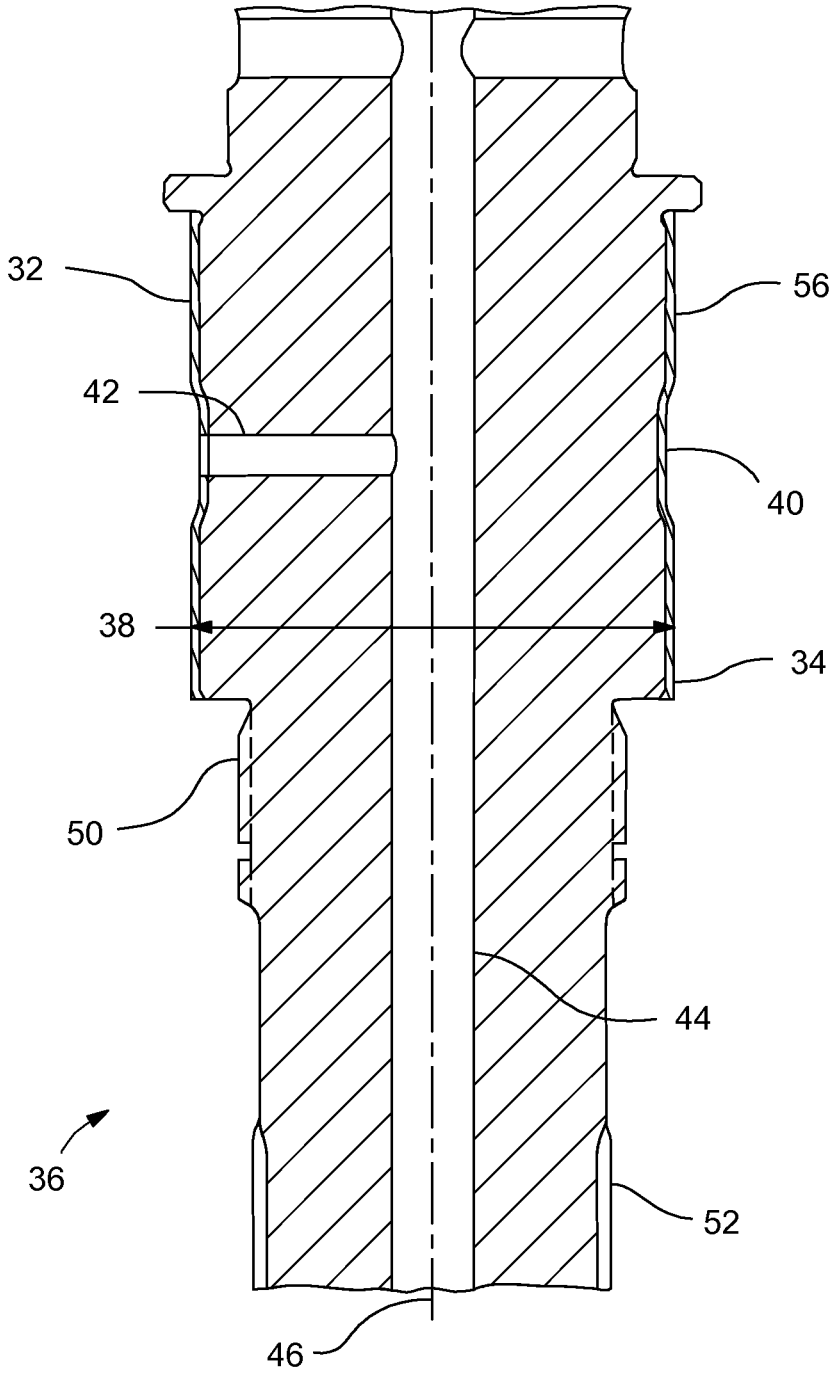
FIG. 3 is a schematic, cross section view, on an enlarged scale, of a portion of the main shaft.
Figure 4:
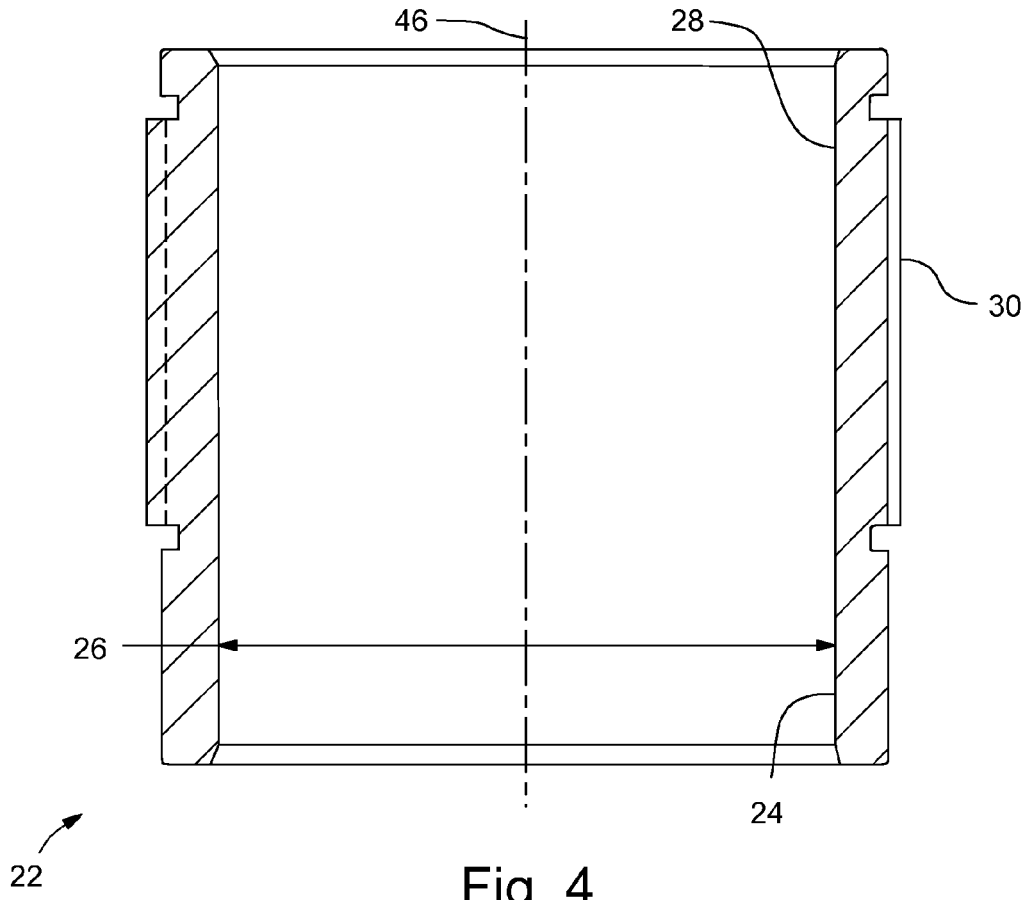
FIG. 4 is a schematic, cross section view, on an enlarged scale, of the hub.
Figure 5:
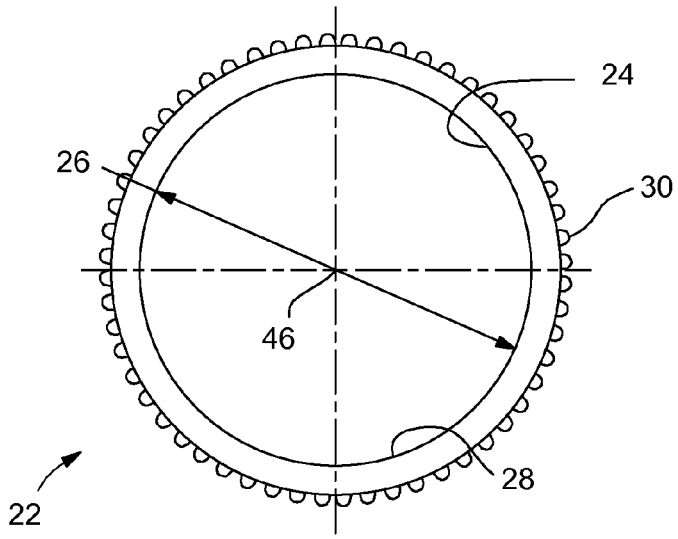
FIG. 5 is a schematic, end view, on a reduced scale relative to FIG. 4, of the hub.

The journal bearing 34 also includes a thin coating 56, which may be made of aluminum bronze material. The thickness of the coating 56 shown in FIGS. 1-3 is not to scale—it is drawn to allow one to see where the coating is applied. The rest of the main shaft 36 and the hub 22 may be made of steel, such as a carburized and hardened 80/26 steel. The coating 56 is applied during a remanufacturing process for the main shaft 36 and hub 22.

The remanufacturing process for the hub 22 and main shaft 36 will now be discussed. The hub 22 may be washed and inspected for external damage and severe internal damage. If there is any damage, then the hub 22 may not be fit for use in a remanufactured transfer case. For example, if the hub bearing surface 28 is worn beyond a predetermined inside diameter 28 surface dimension, then it may be deemed too worn to reuse, in which case it is discarded. A new hub 22 may be used in the remanufactured transfer case instead.

If, on the other hand, the hub 22 is within the limits of wear, then the hub bearing surface 28 is machined to re-establish the centerline (so that it aligns with the longitudinal axis 46), to increase the inside diameter 26 to a predetermined dimension, and to finish hone the surface to a predetermined finish specification. Plateau honing may be employed rather than conventional grinding of the surface, if so desired. The plateau honing may create a surface that helps to retain an oil film on the hub bearing surface 28 even under marginal lubrication conditions in the transfer case.

The main shaft 36 may be washed and inspected for the amount of wear and damage. For example, the main shaft 36 may be inspected for residual machining chips in the oil holes 42, for damage to the splines 48, 50, 52, 54, and the bearing surface 32 may be inspected for gauges. Damage in these areas may render the main shaft 36 unusable, in which case it would not be a candidate for remanufacturing and would be discarded. Also, the outside diameter 38 of the journal bearing 34 may be measured to assure that it is at least equal to a predetermined minimum acceptable dimension. This dimension may be set, for example, by determining the initial depth of the carburized case and limiting the acceptable wear to less than this depth. Although, other criteria may be employed to determine the maximum acceptable wear to the journal bearing 34. If the wear is too much, then the shaft may be discarded rather than used in a re-manufactured transfer case.

On the other hand, if the main shaft 36 passes inspection, then the main shaft 36 is prepared for thermal spray. Wax plugs (not shown) may be inserted into the lube holes 42 and cylindrical sleeves (not shown) may be slid over both ends of the main shaft 36 until just the journal bearing 34 is exposed. Or, other masking techniques may be used instead, if so desired. The main shaft bearing surface 32 may then be grit blasted using, for example, silicon carbide, with full coverage of the area to be thermal sprayed and surface textured. After grit blasting is complete, the main shaft bearing surface 32 may be cleaned using, for example, a high pressure blast of gas to eliminate any residual dust from the grit blasting operation.

The surface 32 of the journal bearing 34 may then be thermally sprayed, using, for example, a twin wire arc process, with an aluminum bronze material. For example, the material may be about 90% Cu, 10% Al. The aluminum bronze material has good adhesion properties to the steel of the main shaft 36. The material is added to build up a desired coating thickness. The thickness of the coating may depend upon the outer diameter to which the journal bearing was grit blasted as well as the inside diameter to which the central bore 24 of the hub 22 was machined, if a remanufactured hub will be used, or the nominal inside diameter if the hub 22 is a new one.

After the desired thickness is achieved by thermal spraying, the coating may be machined, for example, by being mounted on a lathe and turned, in order to reach the final desired outside diameter 38. This desired outside diameter 38 is chosen to obtain the desired running clearance between the main shaft bearing surface 32 and the bearing surface 28 of the hub 22. The machining also produces the desired surface finish for the bearing surface 32.

The surface finish on the hub bearing surface 28 and the main shaft bearing surface 32, as well as the aluminum bronze coating, may be important to obtaining good wear and lubrication properties. An example of a possible preferred surface finish for the main shaft bearing surface 32 may be Ra=1.0-2.2. An example of a possible preferred surface finish for the hub bearing surface 28 may be Rpk=0.35 max, Rk=0.4-0.85 and Rvk=1.5-2.9. An example of a possible preferred running clearance is 0.123 millimeters minimum, 0.18 millimeters maximum, with a mean of 0.1515 millimeters. A clearance that is too tight may produce binding concerns during assembly of the components, while a clearance that is too loose might not provide a proper lubrication boundary.

After the desired dimensions and surface properties are achieved in the aluminum bronze coating, the main shaft 36 may be washed and inspected for residual debris, which is removed. The main shaft 36 is now ready for assembly into remanufactured transfer case, with a corresponding hub 22 having the matching inside diameter of its central bore 24 (in order to assure the desired running clearance is achieved).

While certain embodiments of the present invention have been described in detail, those familiar with the art to which this invention relates will recognize various alternative designs and embodiments for practicing the invention as defined by the following claims.

What is claimed is:

1. A method of re-manufacturing a shaft-hub assembly to be used in a transfer case, the method comprising the steps of:

(a) determining an initial diameter of a journal bearing of a main shaft that has been used in the transfer case;

(b) comparing the determined initial diameter to a predetermined minimum threshold;

(c) preparing the bearing surface of the journal bearing for a thermal spray process;

(d) thermally spraying an aluminum bronze material onto the bearing surface;

(e) machining the aluminum bronze material to achieve an outside diameter that provides a desired running clearance with a corresponding finished inside diameter of a central bore for a hub to which the main shaft will be assembled in the transfer case;

(f) determining the initial inside diameter of the hub that has been removed from the transfer case;

(g) comparing the initial inside diameter to a predetermined maximum threshold;

(h) if the initial inside diameter is greater than the predetermined maximum threshold, discarding the hub and using a new hub to mate with the main shaft; and (i) if the initial inside diameter is less than the predetermined maximum threshold, machining the hub to increase the initial inside diameter to the finished inside diameter of the central bore of the hub.

2. The method of claim 1 wherein step (e) is further defined by determining the desired outside diameter of the aluminum bronze material on the journal bearing based on whether the finished inside diameter is for the new mating hub or the hub that has been machined to increase the initial inside diameter.

3. The method of claim 1 wherein step (i) is further defined by the machining process including plateau honing the initial inside diameter of the central bore.

4. The method of claim 1 wherein step (i) is further defined by surface finish of the finished inside diameter having a Rpk=0.35 micrometers max, a Rk=0.4-0.85 micrometers and a Rvk=1.5-2.9 micrometers.

5. The method of claim 1 further comprising the steps of:

(f) inspecting the bearing surface of the journal bearing to determine if any gouge exists that will prevent remanufacturing of the main shaft; and (g) discarding the main shaft if the gouge exists.

6. The method of claim 1 wherein step (d) is further defined by the aluminum bronze material being about ninety percent copper and about ten percent aluminum.

7. The method of claim 1 wherein step (e) is further defined by the surface finish of the outside diameter being in the range of 1.0<=Ra<=2.2 micrometers.

8. The method of claim 1 wherein step (e) is further defined by the running clearance being greater than or equal to 0.123 millimeters and less than or equal to 0.18 millimeters.

9. The method of claim 1 further including, after steps (d) and (e), (f) installing the hub onto the main shaft and installing the shaft-hub assembly into the transfer case.

10. The method of claim 1 wherein step (c) is further defined by preparing the surface of the journal bearing by masking all of the main shaft except for the journal bearing and grit blasting the journal bearing.

11. The method of claim 10 wherein step (c) is further defined by using a high pressure blast of gas on the journal bearing after the grit blasting operation to remove residual dust from the journal bearing.

12. The method of claim 1 wherein step (d) is further defined by thermally spraying the aluminum bronze material using a twin wire arc process.

* * * * *